United States Patent [19]

Khoury

[11] 4,002,262

[45] Jan. 11, 1977

[54] VENTED EASY-OPEN END CLOSURE WITH ANTI-TEAR MECHANISM

[75] Inventor: Nick S. Khoury, Worth, Ill.

[73] Assignee: The Continental Group, Inc., New York, N.Y.

[22] Filed: May 10, 1976

[21] Appl. No.: 684,684

[52] U.S. Cl. ..... 220/271; 220/375

[51] Int. Cl.[2] ..... B65D 41/32

[58] Field of Search ..... 220/269–274, 220/375

[56] References Cited

UNITED STATES PATENTS

| | | | |
|---|---|---|---|
| 3,684,126 | 8/1972 | Reichert | 220/273 |
| 3,838,788 | 10/1974 | Stargell | 220/271 |
| 3,967,752 | 7/1976 | Cudzik | 220/269 |

*Primary Examiner*—George T. Hall
*Attorney, Agent, or Firm*—Paul J. Lerner; Joseph E. Kerwin; John J. Kowalik

[57] ABSTRACT

An improved vented, easy-opening end closure having an opening score line and a vent score line and a pull tab provided with an integral tether secured to the end panel and operative to effect, in the areas immediately adjacent the ends of the vent score line, primarily tension stresses and to reduce the stress components normal to the end panel which tear the end panel and thus frustrate opening of the container.

9 Claims, 5 Drawing Figures

VENTED EASY-OPEN END CLOSURE WITH ANTI-TEAR MECHANISM

SUMMARY OF THE INVENTION

The present invention relates to container end closures and, more particularly, to easy-opening closures for pressurized containers.

It is often necessary or desirable to form a vent opening in an easy-opening end closure to release or admit pressure in such packed containers before the initial rupture of the flap-defining score line.

This is frequently accomplished by the provision, in the end panel, of a generally horseshoe-shaped or moustache-shaped vent score line embracing the pull tab attachment rivet and terminating in end portions relatively closely adjacent the opening score line. Unfortunately, the stress loading imposed on the end panel during opening is such as to occasionally cause tearing in the areas between the opening score line and the end portions of the vent score line. This tearing is undesirable in that it may result in malfunction of the closure and also because it detracts from the appearance thereof.

It is therefore a primary object of the present invention to provide an improved vented, easy-opening end closure which is not subject to tearing of the end panel in the areas between the opening score line and the end portions of the vent score line. This is accomplished by attaching the pull tab to the end panel so as to redirect the opening forces whereby the stress loading on the aforesaid areas is primarily in tension and the stress components thereon normal to the end panel are substantially reduced.

BRIEF DESCRIPTION OF THE DRAWINGS

With the above and other objects in view that may hereinafter appear, the nature of the invention will be more clearly understood by reference to the following description when viewed in light of the accompanying drawings, in which.

BRIEF DESCRIPTION OF THE PREFERRED EMBODIMENT

Figure 1:
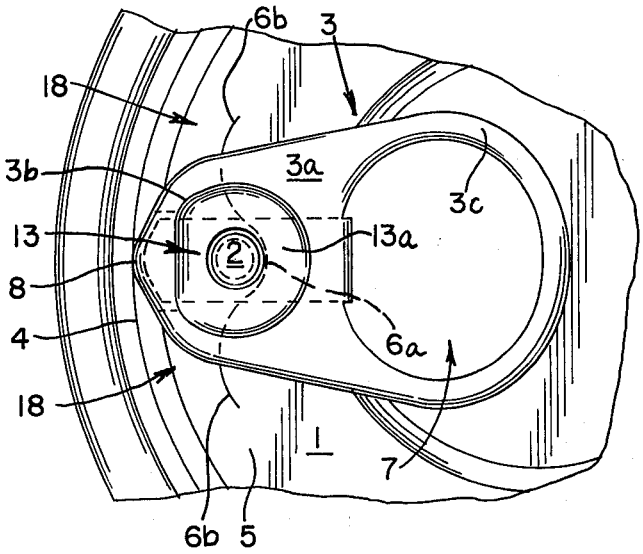
FIG. 1 is a fragmentary top plan view of the end closure of the present invention.
Figure 2:
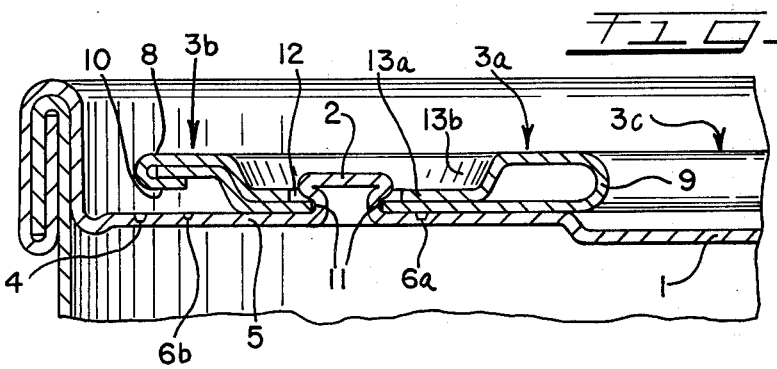
FIG. 2 is a fragmentary cross-sectional view taken substantially along line 2—2 of FIG. 1.

As shown in the drawings, the improved easy-opening end closure of this invention comprises an end panel 1 having an integrally formed rivet 2 and a pull tab 3 fixedly attached to the end panel 1 thereby. An opening score line 4 is formed in the end panel 1 and encircles an opening flap 5. A moustache-shaped vent score line 6 is also formed in the end panel 1, with the bight portion 6*a* thereof embracing the rivet 2 and the two end portions 6*b* relatively closely adjacent the opening score line 4.

The pull tab 3, formed from a single piece of sheet metal, comprises a body 3*a*, including a nose portion 3*b* and a substantially C-shaped grasping portion 3*c* which combines with the nose portion 3*b* to define an aperture 7 through the tab 3. A fracturing member 8 is formed on the nose portion 3*b*, in spaced relation with the opening score line 4.

A tether 9, composed of metal displaced to form the aperture 7, is integrally attached to the nose portion 3*b*. The tether 9 is folded under the nose portion 3*b* toward the fracturing member 8. A panelwardly directed peripheral curl 10 is formed on the nose portion 3*b* and clampingly holds the distal portion of the tether 9 thereagainst.

The rivet 2 passes through a hole 11 formed in the tether 9 and clampingly attaches the same to the end panel 1. A clearance hole 12 is formed in the base 13*a* of a generally circular well 13 in the nose portion 3*b*, concentric with the first hole 11. The rivet 2 projects through, but does not engage the clearance hole 12.

To open the end closure, the grasping portion 3*c* is lifted, resulting in fracture of the vent score line 6 and controlled tearing therealong. The pull tab 3 and the opening flap 5 are thereby caused to pivot about the end panel portions 18 between the opening score line 4 and vent score line 6. As the pull tab 3 pivots the fracturing member is displaced panelwardly and contacts the end panel 1 adjacent the opening score line 4. Continued lifting of the grasping portion 3*c* causes fracture of the opening score line 4 and controlled tearing therealong in the manner of conventional end closures.

Figure 5:
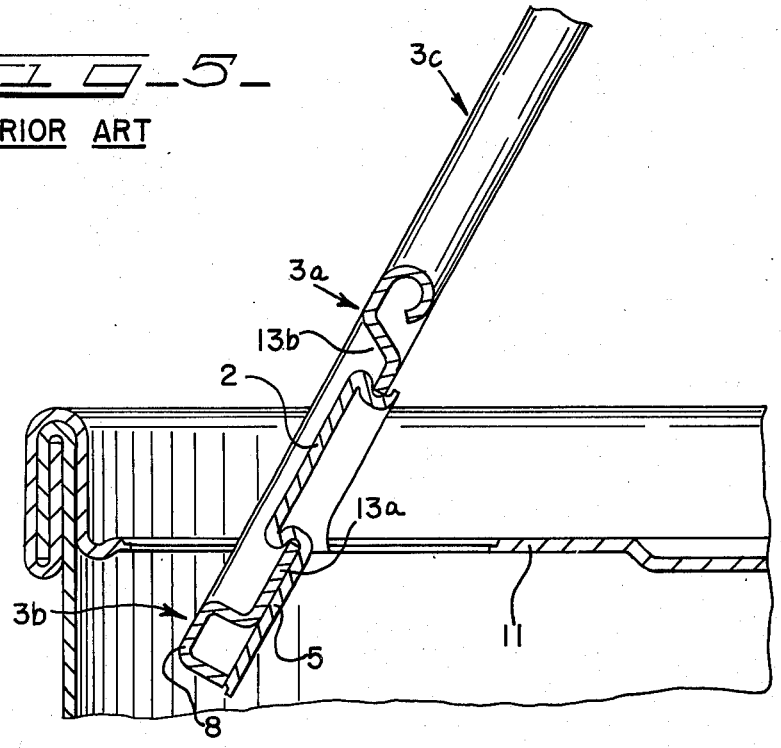
FIG-5- PRIOR ART
FIG. 5 is a fragmentary cross-sectional view of the prior art end closure, illustrating the closure in a partially opened condition.

As shown in FIG. 5, when an end closure of the prior art is opened, the opening forces on end panel portions 18 just prior to fracture of the opening score line 4 are primarily normal to the plane of the end panel 1. Such forces tend to cause uncontrolled and undesirable tearing of the portions 18. This tearing most commonly commences at one or both ends of the vent score line 6 and may proceed to the extent that a line of separation may develop connecting the opening score line 4 with the vent score line 6.

Figure 3:
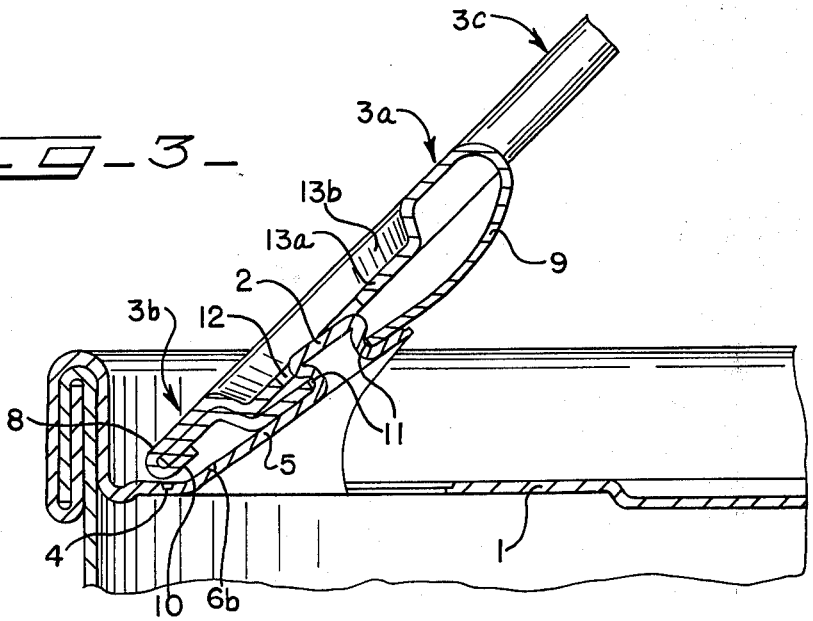
FIG. 3 is a fragmentary cross-sectional view similar to FIG. 3, illustrating the closure in a partially opened condition.
Figure 4:
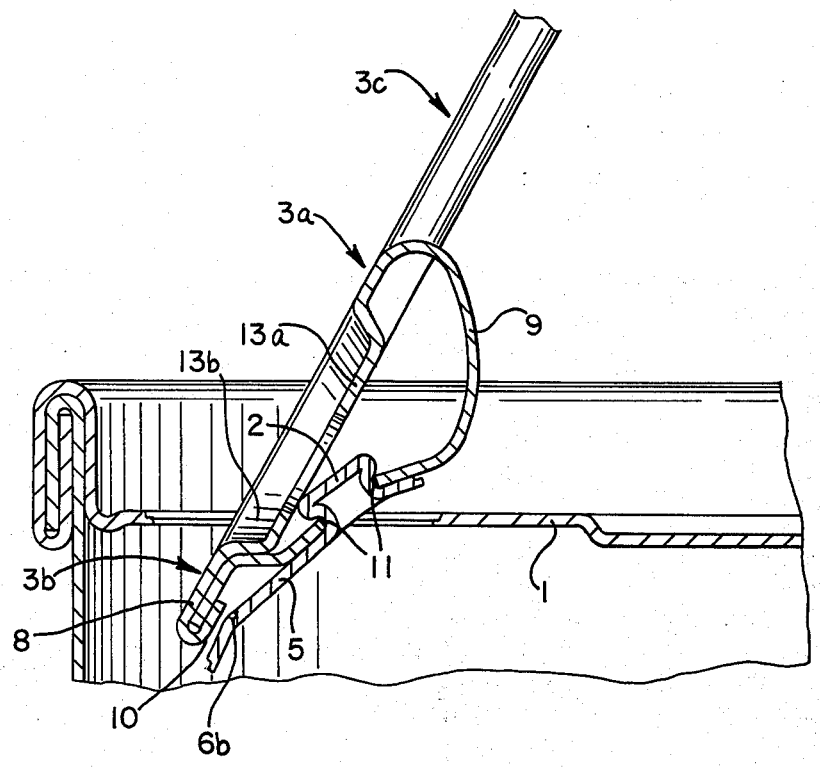
FIG. 4 is a fragmentary cross-sectional view, similar to FIG. 3 but illustrating a more advanced stage in the opening process.

In the end closure of the present invention, the pull tab 3 may be rotated through an angle A before the tether 9 becomes taut and transmits a stress to the vent score line 6. As the vent score line 6 ruptures and tearing therealong occurs, the pull tab 3 continues to rotate. Thus, when the point is reached, as shown in FIG. 3, where further rotation of the pull tab 3 will result in the opening score line 4, the stress loading on the end panel portions 18 is primarily in tension and the stress components normal to the end panel 3 are substantially reduced.

This reduction of the normal stress prevents the tearing of the end panel 3 at the ends of the vent score line 6.

Once the opening score line 4 has been fractured, the operation of the present end closure is identical with that of the prior art.

I claim:

1. An improved easy-open end closure of the type comprising an end panel and a pull tab, said end panel having an opening score line defining an opening flap therein, said flap having a vent score line defining a vent therein, said vent score line including distal end portions spaced apart from said opening score line, said pull tab comprising a body including a nose portion and a grasping portion; the improvement comprising force-redirecting attachment means attaching said pull tab to said flap whereby tearing of the end panel portions between said opening score line and said distal end portions is prevented, said attachment means including means including a tether integrally connected to said pull tab intermediate said portions, said tether being folded under said pull tab body and toward said nose portion and secured to said flap by said attachment means, whereby said pull tab body is displaceable prior to rupture of said opening score line to a position relative to said end panel whereat the stress loading on said end panel in the areas immediately adjacent said distal ends of said vent score line is primarily in tension and the stress components thereon normal to said end panel are substantially reduced.

2. The invention according to claim 1, wherein said attachment means includes a rivet integrally formed in said flap, said pull tab body being formed with a clearance opening, and said rivet projects through said clearance opening without engaging said pull tab body.

3. The invention according to claim 2, wherein said pull tab is completely formed from a single piece of sheet metal and said tether is provided by metal displaced to form said grasping portion.

4. The invention of claim 3, wherein the distal end of said tether underlies said nose portion of said pull tab, said nose portion having panelwardly directed peripheral curl clamping said distal end of said tether thereagainst, said end of said tether serving to strengthen and rigidify said nose portion.

5. The invention of claim 4, wherein said nose portion of said pull tab includes fracturing means for fracturing said opening score line consequent to lifting said grasping portion of said pull tab, and said fracturing means is maintained in spaced relation with said opening score line.

6. An improved pull tab for use with a ventable easy-opening end closure including a nose portion and a grasping portion, said nose portion comprising superposed upper and lower panel portions, said panel portions having concentric passages therethrough, the passage through said lower panel portion being smaller than the passage through said upper panel portion, whereby said pull tab may be fastened to an end closure end panel by a rivet projecting through both of said passages, with said rivet engaging only said lower panel portion.

7. The invention of claim 6, wherein said pull tab is completely formed from a single piece of sheet metal and said lower panel portion is provided by metal displaced to form grasping portion.

8. The invention of claim 7, wherein said upper and lower panel portions are integrally joined by a flexible hinge portion.

9. The invention of claim 8, wherein said upper panel portion has a peripheral panelwardly directed curl clamping the distal end of said lower panel thereagainst whereby said nose portion is strengthened and rigidified.

* * * * *